United States Patent [19]

O'Connell

[11] Patent Number: 4,848,660

[45] Date of Patent: Jul. 18, 1989

[54] APPARATUS FOR CARRYING A SUPPLY OF LIQUID

[75] Inventor: Mark E. O'Connell, Cedar Grove, Wis.

[73] Assignee: Thomas Industries, Inc., Sheboygan, Wis.

[21] Appl. No.: 31,722

[22] Filed: Mar. 30, 1987

[51] Int. Cl.[4] ..... B05B 9/08

[52] U.S. Cl. ..... 239/154; 222/175; 224/259

[58] Field of Search ..... 239/152, 153, 154, 653; 222/175; 224/209, 259, 153

[56] References Cited

U.S. PATENT DOCUMENTS

| | | | |
|---|---|---|---|
| 222,831 | 12/1879 | Marsh | 239/154 |
| 276,613 | 5/1883 | Loomis et al. | 239/153 |
| 1,635,928 | 7/1927 | Davis | 224/209 |
| 1,875,992 | 9/1932 | Clifford | 239/153 |
| 2,013,358 | 9/1935 | Osborne | 239/153 |
| 2,606,701 | 8/1952 | Huthsing | 239/153 |
| 3,721,299 | 3/1973 | Roessler | 239/154 |
| 3,966,092 | 6/1976 | Ballu | 239/153 |

FOREIGN PATENT DOCUMENTS

| | | | |
|---|---|---|---|
| 322712 | 6/1902 | France | 239/152 |
| 1032828 | 7/1953 | France | 239/154 |

*Primary Examiner*—Andres Kashnikow
*Assistant Examiner*—Michael J. Forman
*Attorney, Agent, or Firm*—James G. Staples

[57] ABSTRACT

The invention relates to a portable container for liquid. The container has a reservoir with an upper opening for filling and an outlet forming a source of supply. The container is equipped with a strap which operates both as a shoulder strap and a carrying handle. The strap is made of a single piece of material and two upper locations are fixed to the upper part of the container, while the ends of the strap are adjustably attached to the lower part of the container.

3 Claims, 1 Drawing Sheet

Fig. 1.
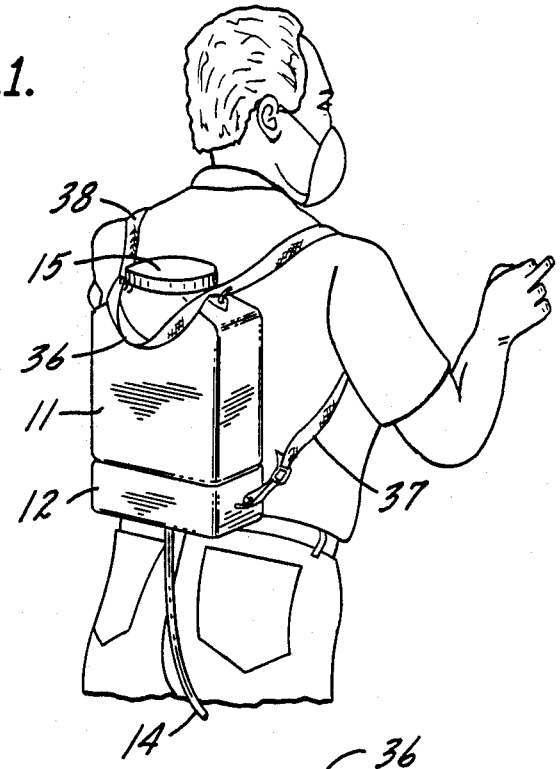
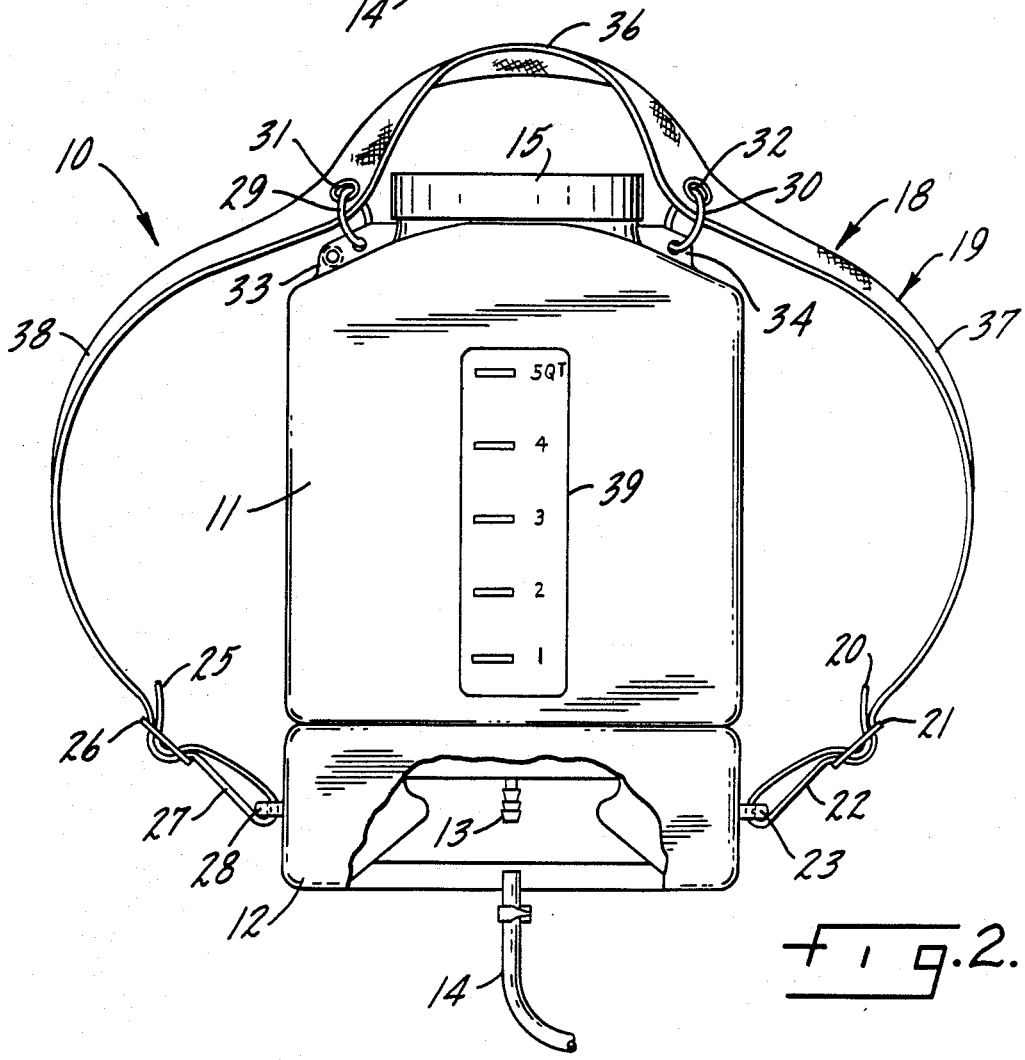
Fig. 2.

APPARATUS FOR CARRYING A SUPPLY OF LIQUID

This application relates generally to a human portable liquid container. More specifically it relates to a container especially adapted to be carried by an individual for use as a supply container for liquids such as paint, agricultural or horticultural liquids which are applied by spray means, such as a conventional hand held spray gun.

BACKGROUND OF THE INVENTION

Human portable spray gun systems, which invariably include a spray gun, a source of spray liquid connected to the spray gun by a tube and a source of power for the spray gun, have been known for many years as epitomized by U.S. Pat. Nos. 2,162,057 and 2,692,799. Such prior systems have frequently been uncomfortable to use because the means for suspending the source of spray liquid, i.e.: the tank, from the back of the wearer have caused discomfort, usually because a shoulder straps are so arranged as to cut, or at least dig, into the flesh of the wearer at a sharp angle.

Further, since these devices are intended for the do-it-yourself segment of the retail market, the cost of such products is important. In this regard the suspension system frequently increases the cost unnecessarily, as contrasted to the present invention, because the combination of handles, clamps, straps, and different styles of connectors have been employed.

SUMMARY OF THE INVENTION

This invention is a human portable liquid container assembly which can be worn for extended periods, as contrasted with prior devices intended to perform the same function, with less fatique to the user than prior known assemblies. At the same time, the cost of the assembly, which consists of a liquid container and a strap system, is very low since (i) a single length of strap serves the multiple purposes, without alteration by the user, of both suspension strap means and lifting handle, and (ii) only two simple ring connectors are required to arrange the single length of strap forming the strap means as both a handle and independently adjustable body strap.

BRIEF DESCRIPTION OF THE DRAWINGS

The invention is illustrated more or less diagrammatically in the accompanying drawing in which FIG. 1 is a perspective view of the portable liquid container assembly in use; and FIG. 2 is a front elevation of the liquid container which more clearly illustrates the single length of strap which forms the handle and the two shoulder straps.

DESCRIPTION OF A SPECIFIC EMBODIMENT

In the following description of a specific embodiment of the invention, like reference numerals will be used to refer to like parts from Figure to Figure of the drawing.

Referring first to FIG. 2, the liquid container and its associated suspension system of this invention is indicated generally at 10. The system consists of a liquid container comprised of a liquid holding reservoir 11 which is mounted, by any suitable means, on a reservoir base 12. The mounting means is not essential and is not further described except that preferably the base 12 is at least partially hollow to accommodate a hose nipple 13 which serves as a means for connecting the reservoir 11 to a hose 14 leading to a spray apparatus, not shown. A wide mouth is formed at the upper end of the reservoir, said wide mouth being closed by a top 15 which may be secured by any suitable means, such as screw threads, not shown, to the liquid reservoir. A conventional vent hole may be provided in top 15 if desired.

The suspension system is indicated generally at 18. The system includes a continuous strap means 19 and connecting means for forming two shoulder straps and a handle from the single continuous strap means. One end 20 of the continuous strap means is formed into a loop by clip 21 and the loop 22 is connected to an ear 23 located at the lower end portion of the liquid container. The other end 25 of the continuous strap means is formed into a loop by clip 26 and the so-formed loop 27 is connected to an ear 28 located at the lower end portion of the liquid container at the opposite side thereof.

Continuous strap 19 is connected, intermediate its ends 20 and 25, to the liquid container by rings 29, 30 which pass through holes 31, 32 respectively in the strap means, and apertures in upper ears 33, 34 which extend outwardly from the upper end portion of the reservoir. As a result, a handle 36 is formed between the two points of connection, and two shoulder loops 37, 38 are formed between each adjacent pair of ears on each side of the liquid container.

In operation, after filling the reservoir 11 to a desired level as available, or as measured by the gauge 39 on the front of the tank, the user slips his arms through the two shoulder loops 37, 38 formed on each side of the reservoir between ears 33 and 28 on the left side, and ears 34 and 23 on the right side, all as best illustrated in FIG. 1. Liquid to be sprayed or otherwise dispensed exits the reservoir 11 via hose nipple 13 and hose 14 and passes to a spray gun or other dispensing device which may be hand held by the user.

The length of the shoulder straps may be easily adjusted without disturbing the handle by simply moving the clips 21, 26, independently of each other, toward or away from the liquid container to shorten or lengthen loops 22, 27 respectively, and thereby accommodate the entire system to the user.

When not in use the loop 36 provides a convenient handle for moving the system from place to place.

Although a specific embodiment of the invention has been illustrated and described, it will be appreciated that changes and variations may be made without departing from the scope of the invention. Accordingly it is intended that the scope of the invention be limited solely by the hereafter appended claims when interpreted in light of the relevant prior art, and not by the foregoing exemplary description.

I claim:

1. In a portable liquid assembly for a spray apparatus, the combination of a container having an opening for filling and rapid emptying, and a liquid outlet arranged to form a source of supply to a spray apparatus, and a combined handle and shoulder suspension system, said system including strap means having its two ends secured to the liquid container adjacent the lower end of the liquid container, said strap means being connected to the upper end portion of the container at two spaced locations, each adjacent the side extremity of the container, the connection between said strap means and said upper end substantially preventing sliding motion of said strap at said connection, whereby two shoulder straps are formed, and a handle secured to the container at the two spaced locations at which the upper end portions of the two shoulder straps are connected, said handle being of fixed length whereby lifting of said assembly by said handle does not substantially change said length, said handle and two shoulder strap means beings formed from one continuous piece of strap means.

2. The portable liquid container assembly for a spray apparatus of claim 1 further characterized in that the strap means is connected to the upper end portion of the container at said two spaced locations by a ring at each location, each ring passing through an aperture in the strap and an aperture formed on the container.

3. The portable liquid container assembly for a spray apparatus of claim 2 further characterized in that the length of each shoulder strap is independently variable one from the other by extending or contracting each individual shoulder strap at the location at which it is connected to the lower end portion of the liquid container.

* * * * *